US009937980B2

(12) United States Patent
Tang et al.

(10) Patent No.: US 9,937,980 B2
(45) Date of Patent: Apr. 10, 2018

(54) BIONIC HIGH HOLDING POWER ANCHOR

(71) Applicant: JIANGSU UNIVERSITY OF SCIENCE AND TECHNOLOGY, Zhenjiang, Jiangsu (CN)

(72) Inventors: Wenxian Tang, Jiangsu (CN); Wenle Wu, Jiangsu (CN); Jian Zhang, Jiangsu (CN); Tian'an Liao, Jiangsu (CN); Ze Sun, Jiangsu (CN); Xiaorong Wang, Jiangsu (CN); Jintai Li, Jiangsu (CN); Li Zhang, Jiangsu (CN); Ziyang Huang, Jiangsu (CN)

(73) Assignee: Jiangsu University of Science and Technology, Zhenjiang, Jiangsu (CN)

( * ) Notice: Subject to any disclaimer, the term of this patent is extended or adjusted under 35 U.S.C. 154(b) by 0 days.

(21) Appl. No.: 15/523,965

(22) PCT Filed: Mar. 29, 2016

(86) PCT No.: PCT/CN2016/077686

§ 371 (c)(1),
(2) Date: May 3, 2017

(87) PCT Pub. No.: WO2017/092206

PCT Pub. Date: Jun. 8, 2017

(65) Prior Publication Data

US 2017/0361904 A1 Dec. 21, 2017

(30) Foreign Application Priority Data

Dec. 1, 2015 (CN) ..... 2015 1 08634851

(51) Int. Cl.

| | |
|---|---|
| ***B63B 21/34*** | (2006.01) |
| ***B63B 21/14*** | (2006.01) |
| *B63B 21/26* | (2006.01) |

(52) U.S. Cl.
CPC ..... *B63B 21/34* (2013.01); *B63B 21/14* (2013.01); *B63B 2021/262* (2013.01); *B63B 2021/265* (2013.01)

(58) Field of Classification Search
CPC ..... B63B 21/34; B63B 21/14
(Continued)

(56) References Cited

U.S. PATENT DOCUMENTS 1,583,795 A * 5/1926 Pasturzak ..... A01K 95/00 114/303
4,403,564 A * 9/1983 Garvin ..... B63B 21/46 114/299
(Continued)

FOREIGN PATENT DOCUMENTS

CN 201040577 3/2008
CN 201597728 10/2010
(Continued)

OTHER PUBLICATIONS

International Search Report filed in PCT/CN2016/077686 dated Aug. 22, 2016.

*Primary Examiner* — S. Joseph Morano
*Assistant Examiner* — Jovon Hayes
(74) *Attorney, Agent, or Firm* — Rankin, Hill & Clark LLP

(57) ABSTRACT

The present invention discloses a bionic high holding power anchor, which includes an anchor rod, a suspension clasp coupled with one end of the anchor rod and an anchor fluke hinged with the other end of the anchor rod, wherein a plurality of fluke heads arranged at equal intervals are extended from a front end of the anchor fluke, fin-like streamlined balance wings are arranged at two sides of the anchor fluke; the fluke head is in a shape of triangle-like taper containing a plane side wall and two curved side walls, the plane side wall is an isosceles triangle, the two curved
(Continued)

side walls are smooth curved surfaces, and the two smooth curved surfaces are symmetrical around a normal plane of the plane side wall. According to the bionic high holding power anchor of the present invention, the balance wings are arranged at the two sides of the anchor fluke, a body is avoided from being turned completely and the anchor reaches to a soil layer at a correct working angle during a process that the anchor is thrown into water; and a longitudinal dimension of the anchor is increased, so that an anti-turning property of the anchor in the soil layer is improved significantly, and a risk of anchor dragging is reduced.

5 Claims, 6 Drawing Sheets

(58) Field of Classification Search
USPC ..... 114/294
See application file for complete search history.

(56) References Cited

U.S. PATENT DOCUMENTS

| | | | | |
|---|---|---|---|---|
| 4,823,721 | A * | 4/1989 | Pekny | B63B 21/243 114/302 |
| 5,540,175 | A * | 7/1996 | Van Den Haak | B63B 21/22 114/293 |
| 6,311,636 | B1 * | 11/2001 | Degenkamp | B63B 21/22 114/297 |
| 6,598,555 | B1 * | 7/2003 | Bruce | B63B 21/26 114/294 |
| 7,836,841 | B2 * | 11/2010 | Tung | B63B 21/34 114/303 |
| 9,261,880 | B2 * | 2/2016 | Seo | G05D 1/0208 |

FOREIGN PATENT DOCUMENTS

| | | |
|---|---|---|
| CN | 103129705 | 6/2013 |
| CN | 203996785 | 12/2014 |
| CN | 10541fi510 | 3/2016 |
| GB | 1475223 | 6/1977 |
| JP | 2005132230 | 5/2005 |

* cited by examiner

BIONIC HIGH HOLDING POWER ANCHOR

TECHNICAL FIELD

The present invention relates to a bionic high holding power anchor, and belongs to the field of shipbuilding.

BACKGROUND

An anchor is a special instrument for mooring, which takes a specific shape. When in use, the anchor is thrown into water, the anchor after being thrown into water can be engaged with subsoil, a holding power is provided via an anchor cable or mooring rope tied to a top of the anchor, so as to enable a ship or other floating body to stay in a predetermined water area. The ship is a mobile carrier, especially large ships in the sea shipping industry travel far away. Due to the different geographic positions of wharfs and ports berthed, underwater geological conditions are varied widely. For a soft or neutral geological submarine, a deepwater high holding power anchor can meet the requirements of ship position as long as an anchor fluke is embedded. As for the sandy gravel submarine, due to hard geology, the penetrating capacity of a conventional deep-water high holding power anchor is worse, the anti-turning capability of the anchor is poor, so that it is prone to dragging risk. It is necessary to improve the structure of the anchor fluke to make it easy to penetrate the soil and improve the positioning capability of the anchor.

For the high holding power anchor working on hard soil, the working performance of the anchor is improved by improving the structure of the fluke head in the prior art as well, such as changing the fluke head of the anchor fluke in a shape of cutting edge, adding convex teeth to the lower part of the anchor fluke, improving the structure of the anchor rod, and changing an angle between the anchor rod and the anchor fluke. However, these improvements on a soil holding capability of the anchor on a hard soil layer are not obvious, a cutting force of the anchor applied to the soil layer is not increased obviously, the ship is collided with the high holding power anchor to damage to the ship body in the process of fishing the anchor due to a permanent angle between the anchor rod and the anchor fluke.

A guitarfish as a deposit feeder is mainly inhabited in shallow, has a blunt, sharp snout length surface and a slightly concave side edge, and often pierces into seabed soil and sand for preying on. Therefore, the fluke head of the high holding power anchor designed by simulating the snout surface of the guitarfish may have better soil-penetrating capability. Pectoral fins at two sides of the guitarfish are flat and smooth, so that the resistance is low due to such structure when the guitarfish is swimming and the body balance can be kept. This structure of a balance wing obtained by simulating the pectoral fins can guarantee that the high holding power anchor has the stronger anti-turning property.

SUMMARY

Object of the invention: in order to overcome the defects in the prior art, the present invention provides a bionic high holding power anchor, which has very high penetrating capability and strong anti-turning property.

Technical solutions: in order to solve the technical problems above, a bionic high holding power anchor according to the present invention includes an anchor rod, a suspension clasp coupled with one end of the anchor rod and an anchor fluke hinged with the other end of the anchor rod, wherein a plurality of fluke heads arranged at equal intervals are extended from a front end of the anchor fluke, fin-like streamlined balance wings are arranged at two sides of the anchor fluke; the fluke head is in a shape of triangle-like taper containing a plane side wall and two curved side walls, the plane side wall is an isosceles triangle, the two curved side walls are smooth curved surfaces, and the two smooth curved surfaces are symmetrical around a normal plane of the plane side wall.

Preferably, the fluke head includes a first half-fluke and a second half-fluke, the first half-fluke and the second half-fluke are symmetric around the plane side wall, a soil-penetrating angle of the first half-fluke $\theta$ is greater than 22° but less than 40°, a soil-plowing angle $\beta$ is increased non-linearly, reaches a maximum value at a tail end of the fluke head of the anchor fluke, is greater than 25° but less than 75°, and a bulldozing angle $\alpha$ of the first half-fluke is no less than 15°, wherein, a y-axis is an intersecting line of the normal plane and the plane side wall, a z-axis is perpendicular to the y-axis in the normal plane, a zero O is a midpoint at a bottom edge of the plane side wall, an OXYZ coordinate system is established according to a right-hand rule, an included angle between a tangent line of an intersecting line of the curved side wall and an XOZ plane and an OX-axis is the soil-turning angle $\beta$, an included angle of an intersecting line of the curved side wall and the normal plane and an OY-axis is the soil-penetrating angle $\theta$, and a half of a vertex angle of the plane side wall is the bulldozing angle $\alpha$ Preferably, an equation of the intersecting line of the first half-fluke and the XOZ plane is $z=76.72-0.82x-0.198x^{1.5}+0.034x^2-0.00112x^{2.5}$.

Preferably, three fluke heads are arranged at equal intervals.

Preferably, the anchor rod is herringbone, a shaft hole is arranged between the adjacent fluke heads, the shaft hole is internally equipped with a hinge shaft connected with the anchor rod, and the anchor fluke is provided with a pin shaft limiting the hinge shaft to move.

Preferably, the ratio of length, width and height of the anchor fluke is within a range of 1.5 to 1.8, wherein the length of the anchor fluke is a distance from an end point of the balance wing to an end point of the balance wing at the other side, the width is a distance from a top point of the fluke head to one end of the anchor fluke, and the height is a thickness of the anchor fluke.

Advantageous effects: the bionic high holding power anchor of the present invention has the following advantages:

1. The anchor fluke is in a three-jaw bionic fluke head structure, a bionic plow-shaped fluke head has a high cutting force applied to the soil layer, the oil penetrating capacity of the anchor in the working process is stronger, particularly in a hard soil layer due to the design of a special shape and angle. The three jaw structure increases the contact area between the anchor and the soil layer, so that the anchor obtains higher grip.

2. The bionic balance wings are arranged at two sides of the anchor fluke, a body is avoided from being turned completely and the anchor reaches to a soil layer at a correct working angle during a process that the anchor is thrown into water; and a longitudinal dimension of the anchor is increased, so that an anti-turning property of the anchor in the soil layer is improved significantly, and a risk of anchor dragging is reduced.

3. The anchor rod is a herringbone rod, the longitudinal width of the anchor rod is increased significantly, and the anchor rod and the anchor body form an embedding condition in the hard soil, so that the anchor positioning capability is improved significantly.

DETAILED DESCRIPTION

Figure 1:
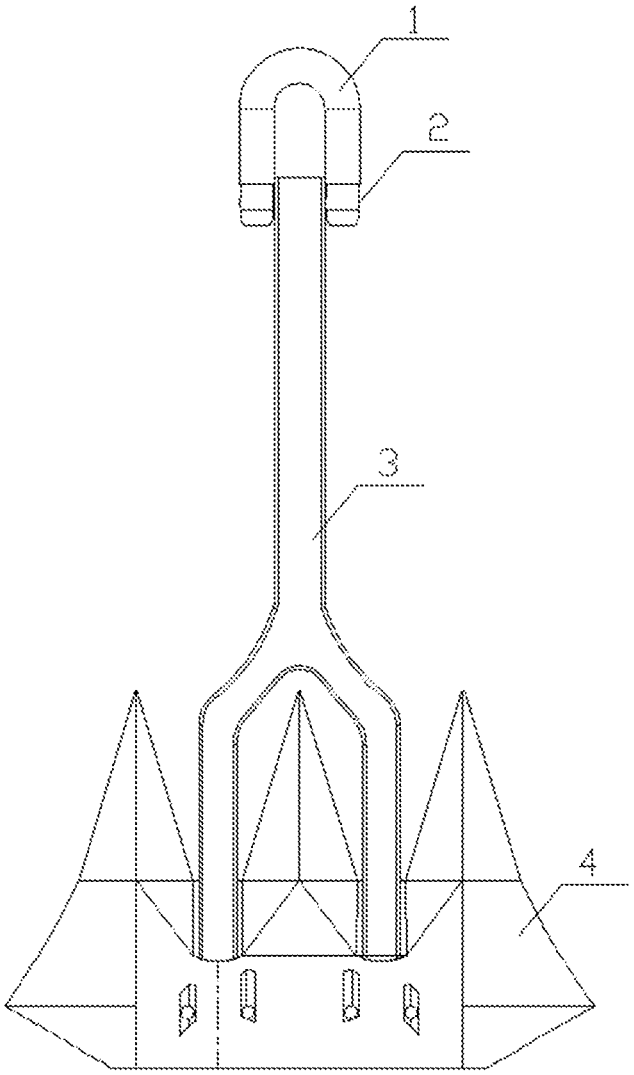
FIG. 1 is a front view of the present invention.

As shown in FIG. 1 to FIG. 9, a bionic high holding power anchor according to the present invention includes an anchor rod 3, a suspension clasp 1 coupled with one end of the anchor rod 3 and an anchor fluke 4 hinged with the other end of the anchor rod 3, wherein the suspension clasp 1 is coupled with the anchor rod 3 via a suspension clasp shaft 2, a plurality of fluke heads 5 arranged at equal intervals are extended from a front end of the anchor fluke 4, and preferably, three fluke heads 5 are arranged at equal intervals, fin-like streamlined balance wings 6 are arranged at two sides of the anchor fluke 4; two anchor rods 3 are provided, a shaft hole is arranged between the adjacent fluke heads 5, the axle shaft is internally equipped with a hinge shaft 7 connected with the anchor rod 3, the anchor fluke 4 is provided with a pin shaft limiting the hinge shaft 7 to move; the fluke head is in a shape of triangle-like taper containing a plane side wall ABC and two curved side walls ABD and ACD, the plane side wall ABC is an isosceles triangle, the two curved side walls ABD and ACD are smooth curved surfaces, and the two smooth curved surfaces ABD and ACD are symmetrical around a normal plane AOD of the plane side wall ABC. The fluke head includes a first half-fluke ABOD and a second half-fluke ACOD, the first half-fluke ABOD and the second half-fluke ACOD are symmetric around the normal plane AOD, ensuring that a soil-penetrating angle of the first half-fluke $\theta \in (22°, 40°)$, a soil-turning angle $\beta$ is increased non-linearly, reaches a maximum value at a tail end of the fluke head of the anchor fluke and $\beta \in (25°, 75°)$. Under the condition of guaranteeing the shape of the curved surface ABD, a bulldozing angle $\alpha$ of the first half-fluke ABOD is no less than 15°, wherein, a y-axis is an intersecting line of the normal plane AOD and the plane side wall ABC, a z-axis is perpendicular to the y-axis in the normal plane AOD, a zero O is a midpoint at a bottom edge of the plane side wall ABC, an OXYZ coordinate system is established according to a right-hand rule, wherein an included angle between a tangent line of an intersecting line of the curved side wall ABD (and/or ACD) and an XOZ plane and an OX-axis is the soil-turning angle $\beta$, an included angle of an intersecting line of the curved side wall ABD (and/or ACD) and the normal plane AOD and an OY-axis is the soil-penetrating angle $\theta$, and a half of a vertex angle of the plane side wall ABC is the bulldozing angle $\alpha$.

Figure 4:
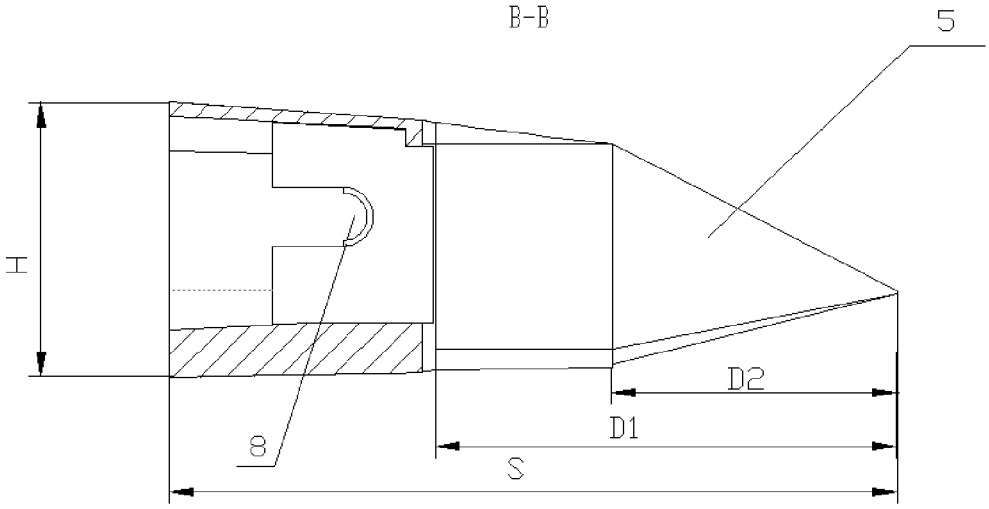
FIG. 4 is a B-B sectional view in FIG. 3.
Figure 5:
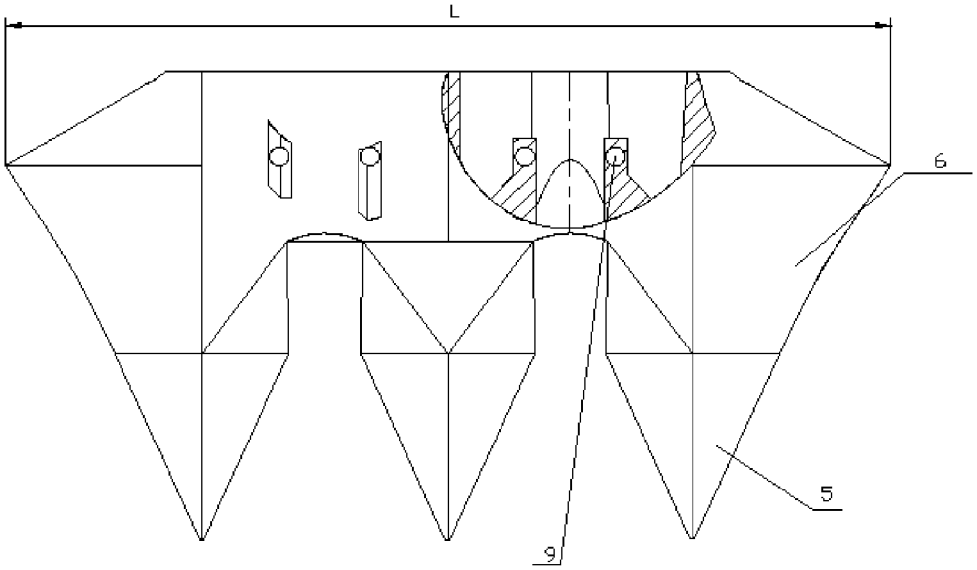
FIG. 5 is a vertical view of the present invention.
Figure 8:
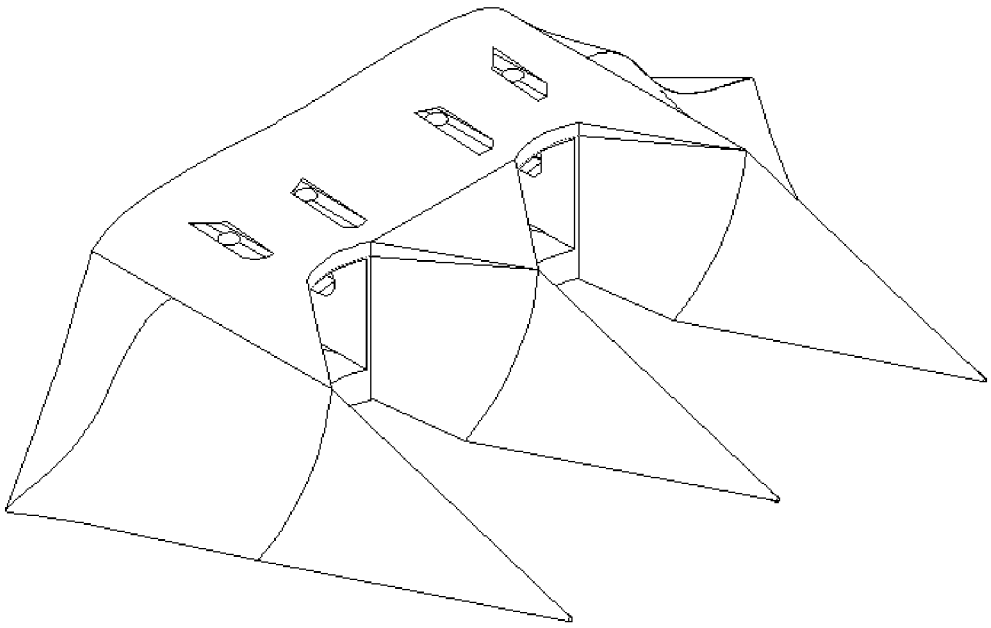
FIG. 8 is a schematic diagram of a three-dimensional perspective of the anchor fluke.

In this embodiment, three longitudinally parallel bionic fluke heads 5 are arranged at the front end of the anchor fluke, and a cross section of the fluke head 5 is as shown in FIG. 4. A three-dimensional modeling of the fluke head 5 is as shown in FIG. 8 and obtained by simulating and modeling the head of guitarfish, the balance wings 6 at two sides of the anchor fluke 4 are obtained by simulating the streamlined pectoral fins at the two sides of the guitarfish, and the sectional dimension of the anchor is increased longitudinally, so that the turning force applied to the anchor is reduced, the entire anti-turning property of the anchor is improved, and a risk of anchor dragging is reduced significantly. Both an upper surface and a lower surface of the anchor fluke 4 are in a structure of slope as shown in FIG. 4, so that the resistance to the bionic high holding power anchor in the process of weighing anchor is lower.

Figure 3:
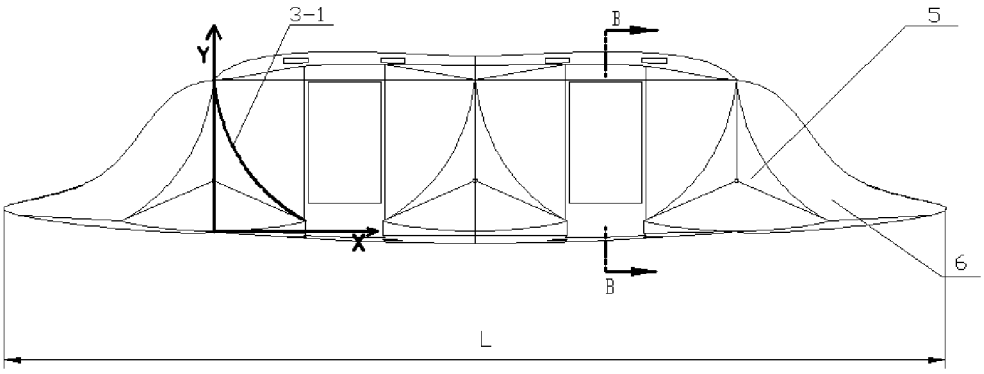
FIG. 3 is a front view of an anchor fluke in FIG. 1.
Figure 7:
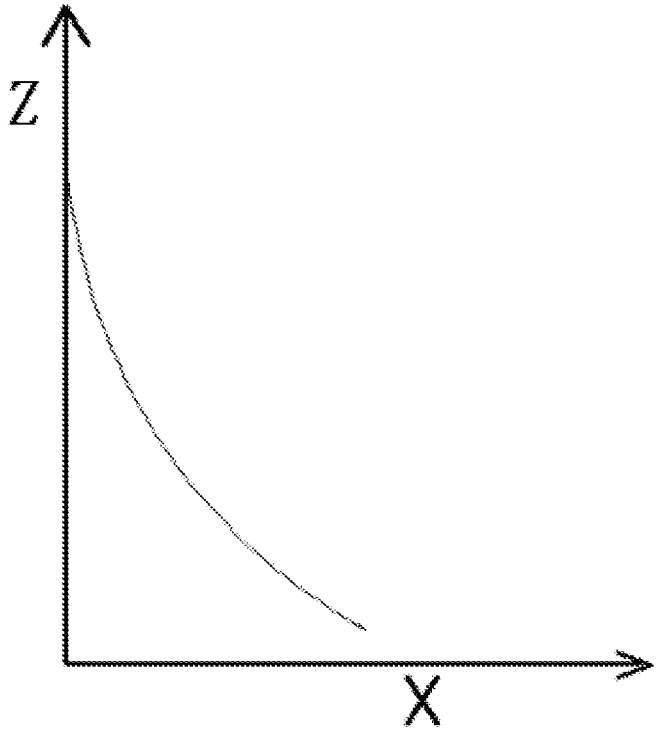
FIG. 7 is a bionic lead curve graph.
Figure 9:
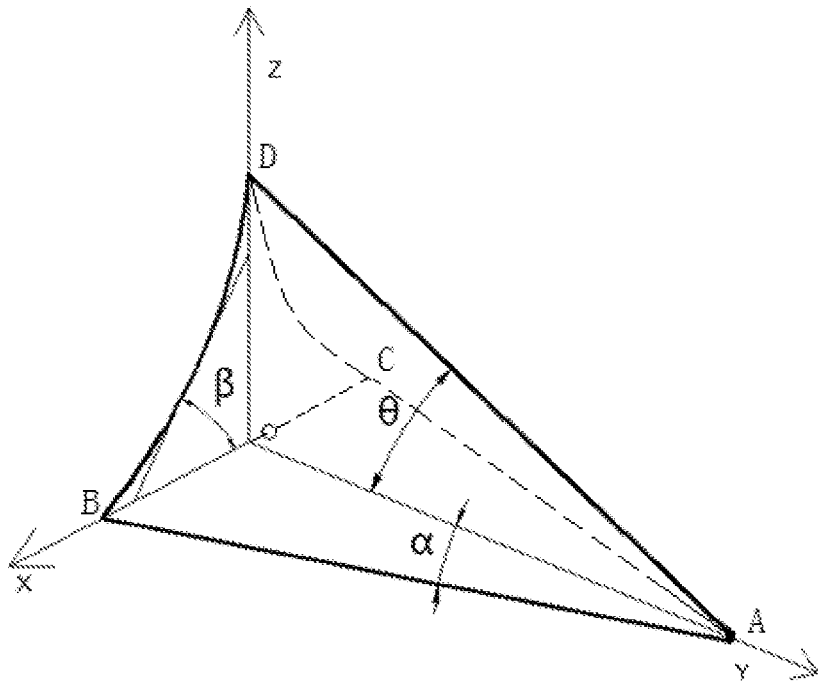
FIG. 9 is a structural schematic diagram of the anchor fluke.

The lead curve of the bionic plow-shaped fluke head 5 of the high holding power anchor is as shown in FIG. 7, and obtained according to a curve equation (1); the curve 3-1 as shown in FIG. 3 meets the curve equation (1), and a curved structure of the fluke head 5 of the anchor fluke as shown in FIG. 8 is configured for the lead curve according to the curve; the curved surface of the fluke head 5 as shown in FIG. 9 is an anchor fluke working surface, or a curved surface constructed by a horizontal straight element method, including a soil-penetrating angle $\theta$, a soil-turning angle $\beta$, and a bulldozing angle $\alpha$. The higher the soil-penetrating angle $\theta$ is increased with the height of the curved surface, the better the soil crushing property is. The soil-turning angle $\beta$ is increased non-linearly, and reaches a maximum value at a tail end of the fluke head. The higher the value is, the better the soil turning property is. When the anchor fluke works, the anchor fluke 4 accesses to the soil to break ground at the soil-penetrating angle $\theta$ and the bulldozing angle $\alpha$, the soil is turned over towards an over-turning and throwing curved surface along a main cutting surface until covering the previous stroke. As shown in FIG. 9, the bionic anchor fluke cutting head makes the soil-turning angle $\beta$ increased non-linearly and up to a maximum value at the tail end of the fluke head 5, under a situation of guaranteeing the shape of the cutting curved surface ABD, $\theta \in (22°, 40°)$, and $\beta \in (25°, 75°)$; meanwhile, the anchor fluke has a larger bulldozing angle $\alpha$ of no less than 15°; the two characteristics make the anchor fluke have a good ability to enter the soil in the soil layer, especially in the hard soil layer. The three fluke heads 5 are arranged at equal intervals and have the same size. Compared with the two fluke heads of the common high holding power anchor, the three fluke heads in parallel have better anti-turning property.

$$z=76.72-0.82x-0.198x^{1.5}+0.034x^{2}-0.00112x^{2.5} \quad (1)$$

Figure 2:
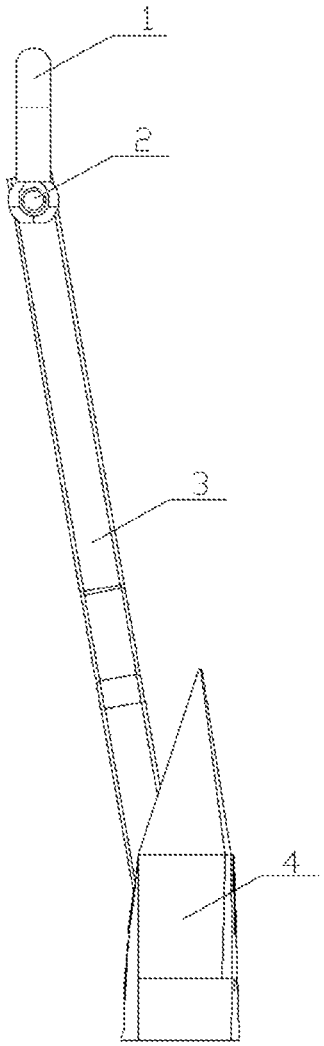
FIG. 2 is a side view of the present invention.
Figure 6:
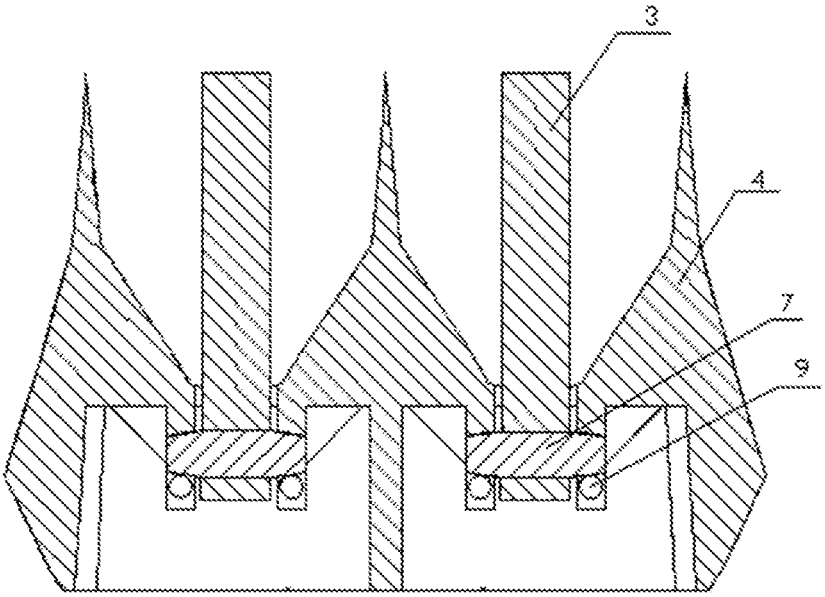
FIG. 6 is a schematic diagram of a connected portion of an anchor rod and an anchor fluke.

In the embodiment, the herringbone anchor rod 3 is obtained by integral casting. Compared with the straight-rod shaped anchor rod of the common high holding power anchor, the longitudinal width of the cross-section of the herringbone anchor rod 3 is increased. A body embedding condition is formed with the participation of the herringbone anchor rod, so that the anchoring force is increased, and the anchor positioning capability is increased. The bionic structure anchor fluke 5 is hinged with the herringbone anchor rod 3. As shown in FIG. 6, the hinge connection is realized via the hinge shaft 7. As shown in FIG. 6, the hinge shaft 7 is matched with the shaft hole 8 inside the anchor fluke 4, the hinge shaft 7 is fixed via a pin shaft 9 as shown in FIG. 6, a radial degree of freedom of the hinge shaft 7 is limited by the pin shaft 9 and the shaft hole 8, and an axial degree of freedom of the hinge shaft 7 is limited by gradual change in the size of the shaft hole. In the entire realization, firstly, the herringbone anchor rod 3 and the anchor fluke 4 are hinged via the hinge shaft 7 and fixed by the pin shaft 9. The front end joint of the herringbone anchor rod 3 is located above the center of the anchor fluke 4, avoiding the anchor from turning during the process of throwing into water, and ensuring that the anchor works at an angle as shown in FIG. 2. The dimension scale of a bionic flow-shaped three-fluke high holding power anchor is as follows, with labels as shown in FIG. 3 and FIG. 4: a length-height ratio of the anchor fluke L:H=5:1, a length-width ratio of the anchor fluke L:S=3:2, and a bionic fluke head proportion $D_1:D_2=3:2$.

The above only describes the preferred embodiments of the invention. It should be noted that those having ordinary skills in the art may also make various improvements and polishing without departing from the principle of the invention, which shall all be deemed as the protection scope of the invention.

The invention claimed is:

1. A bionic anchor, comprising an anchor rod, a suspension clasp coupled with one end of the anchor rod and an anchor fluke hinged with the other end of the anchor rod, wherein a plurality of fluke heads arranged at equal intervals are extended from a front end of the anchor fluke, fin-shaped streamlined balance wings are arranged at two sides of the anchor fluke; each fluke head is in a shape of triangular taper containing a plane side wall and two curved side walls, the plane side wall is an isosceles triangle, the two curved side walls are smooth curved surfaces, and the two smooth curved surfaces are symmetrical around a normal plane of the plane side wall.

2. The bionic anchor according to claim 1, wherein each fluke head comprises a first half-fluke and a second half-fluke, the first half-fluke and the second half-fluke are symmetric around the plane side wall, a soil-penetrating angle of the first half-fluke θ is greater than 22° but less than 40°, a soil-plowing angle β is increased non-linearly, reaches a maximum value at a tail end of each fluke head of the anchor fluke, is greater than 25° but less than 75°, and a bulldozing angle α of the first half-fluke is no less than 15°, wherein, a y-axis is an intersecting line of the normal plane and the plane side wall, a z-axis is perpendicular to the y-axis in the normal plane, a zero O is a midpoint at a bottom edge of the plane side wall, an OXYZ coordinate system is established according to a right-hand rule, an included angle between a tangent line of an intersecting line of the curved side wall and an XOZ plane and an OX-axis is the soil-turning angle β, an included angle of an intersecting line of the curved side wall and the normal plane and an OY-axis is the soil-penetrating angle θ, and a half of a vertex angle of the plane side wall is the bulldozing angle α.

3. The bionic anchor according to claim 2, wherein an equation of the intersecting line of the first half-fluke and the XOZ plane is $z=76.72-0.82x-0.198x^{1.5}+0.034x^2-0.00112x^{2.5}$.

4. The bionic anchor according to claim 3, wherein three fluke heads of the plurality of fluke heads are arranged at equal intervals.

5. The bionic anchor according to claim 4, wherein the anchor rod is herringbone, a shaft hole is arranged between the adjacent fluke heads of the plurality of fluke heads, the shaft hole is internally equipped with a hinge shaft connected with the anchor rod, and the anchor fluke is provided with a pin shaft limiting the hinge shaft to move.

* * * * *